US005308265A

United States Patent [19]

Kaneko

[11] Patent Number: 5,308,265

[45] Date of Patent: May 3, 1994

[54] CONNECTOR TERMINAL HOLDING MECHANISM

[75] Inventor: Tohru Kaneko, Shizuoka, Japan

[73] Assignee: Yazaki Corporation, Tokyo, Japan

[21] Appl. No.: 31,128

[22] Filed: Mar. 12, 1993

[30] Foreign Application Priority Data

Mar. 30, 1992 [JP] Japan ..... 4-73730

[51] Int. Cl.[5] ..... H01R 13/514

[52] U.S. Cl. ..... 439/752; 439/595

[58] Field of Search ..... 439/592, 594, 595, 598, 439/599, 752

[56] References Cited

U.S. PATENT DOCUMENTS

| | | | |
|---|---|---|---|
| 4,705,337 | 11/1987 | Maeda | 439/595 |
| 4,711,508 | 12/1987 | Sueyoshi | 439/595 |
| 5,100,345 | 3/1992 | Endo et al. | 439/752 |
| 5,183,418 | 2/1993 | Yamanashi et al. | 439/752 |

*Primary Examiner*—Gary F. Paumen
*Assistant Examiner*—Hien D. Vu
*Attorney, Agent, or Firm*—Sughrue, Mion, Zinn, Macpeak & Seas

[57] ABSTRACT

Disclosure is a connector terminal holding mechanism which assures that a terminal received in a connector housing can reliably be held in the latter. The connector terminal holding mechanism for reliably holding a terminal including an upright standing engagement portion and an engagement shoulder located forward of the upright standing engagement portion in a connector housing with a rear holder including an engagement portion adapted to be engaged with the upright standing engagement portion is constructed in the improved state in such a manner that a plurality of guide rails each including a raised portion having a height in excess of that of the upright standing engagement portion are formed in the connector housing, and the rear holder merges into an engagement projection including a plurality of slidable portions adapted to be slidably engaged with the guide rails and a plurality of engagement portions adapted to be engaged with a shoulder portion of a box-shaped portion on the terminal.

3 Claims, 4 Drawing Sheets

CONNECTOR TERMINAL HOLDING MECHANISM

BACKGROUND OF THE INVENTION

The present invention relates generally to a connector terminal holding mechanism. More particularly, the present invention relates to a mechanism of the foregoing type for reliably holding a terminal received in a connector with a rear holder.

FIG. 8 is a vertical sectional view of a conventional connector terminal holding mechanism.

This mechanism serves to firmly hold the rear end of a terminal 2 for a base board received in a connector housing 22 molded likewise of a synthetic resin with a rear holder 25 molded of a synthetic resin.

As shown in FIG. 9, the terminal 2 includes a box-shaped portion 5 having a resilient contact piece 23 integrated therewith to come in close contact with an opponent terminal (not shown) and a cable crimping portion 3 located behind the box-shaped portion 5, and the rear part of the cable crimping portion 3 is caused to stand upright so as to form an upright standing engagement portion 4 adapted to be engaged with the rear holder 22. The rear holder 22 is prepared in the flat plate-shaped configuration and includes an engagement portion 24 at the foremost end thereof to be engaged with the upright standing engagement portion 24. In addition, the rear holder 22 includes a flexible arm 25 slantwise upwardly extending therefrom so as to reliably hold the terminal 2 in a housing 21 (refer to Japanese Utility Model Laid-Open Publication NO. 58-14684) .

With the conventional mechanism constructed in the above-described manner, however, a height h of the upright standing engagement portion 4 of the terminal 2 varies depending on the extent of crimping the cable crimping portion 3. Thus, when the height h is lower than a predetermined height one, there arises a malfunction that any engagement fails to be achieved with the rear holder 22.

SUMMARY OF THE INVENTION

The present invention has been made in consideration of the foregoing background and its object to provide a connector terminal holding mechanism which assures that a terminal can reliably be held by a rear holder.

To accomplish the above object, the present invention provides a connector terminal holding mechanism for reliably holding a terminal including an upright standing engagement portion and an engagement shoulder located forward of the upright standing engagement portion in a connector housing with a rear holder including an engagement portion adapted to be engaged with the upright standing engagement portion, wherein the connector terminal holding mechanism is characterized in that a plurality of guide rails each including a raised portion having a height in excess of that of the upright standing engagement portion are arranged in the connector housing and that the rear holder merges into an engagement portion including a plurality of slidable portions adapted to be slidably engaged with the guide rails and a plurality of engagement portions adapted to be engaged with the engagement shoulder of the terminal.

As the rear holder is inserted into the connector housing, the slidable portions of the rear holder slidably move along the respective guide rails on the connector housing and climb the raised portions, whereby the engagement portions of the rear holder come in contact the engagement shoulder of the terminal. Thus, the terminal can be held in the locked state regardless of the height of the upright standing engagement portion (which is liable to vary depending on the extent of crimping), and moreover, the terminal can be twice locked by the rear holder in cooperation with the upright standing engagement portion.

BRIEF DESCRIPTION OF THE DRAWINGS

FIG. 7(*b*) is a perspective view of a male type terminal of the present invention;

DETAILED DESCRIPTION OF THE PREFERRED EMBODIMENT

The present invention will now be described in detail hereinafter with reference to FIG. 1 to FIG. 7 which illustrate a preferred embodiment of the present invention.

Figure 1:
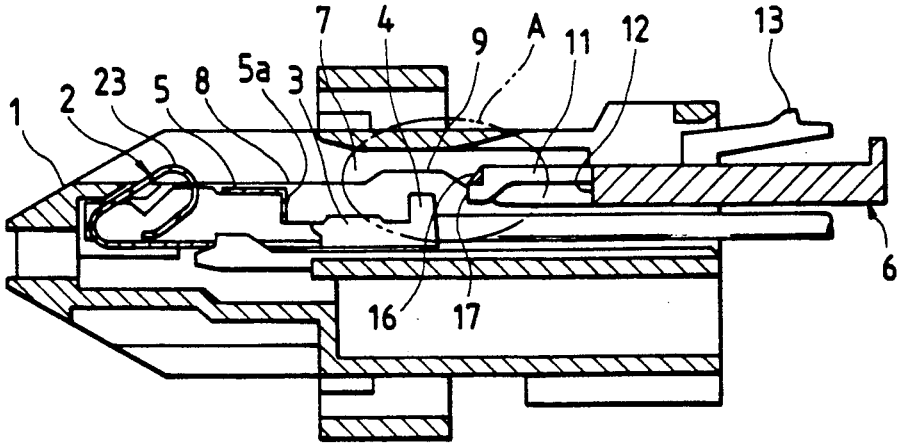
FIG. 1 is a vertical sectional view of a connector terminal holding mechanism in accordance with an embodiment of the present invention.
Figure 2:
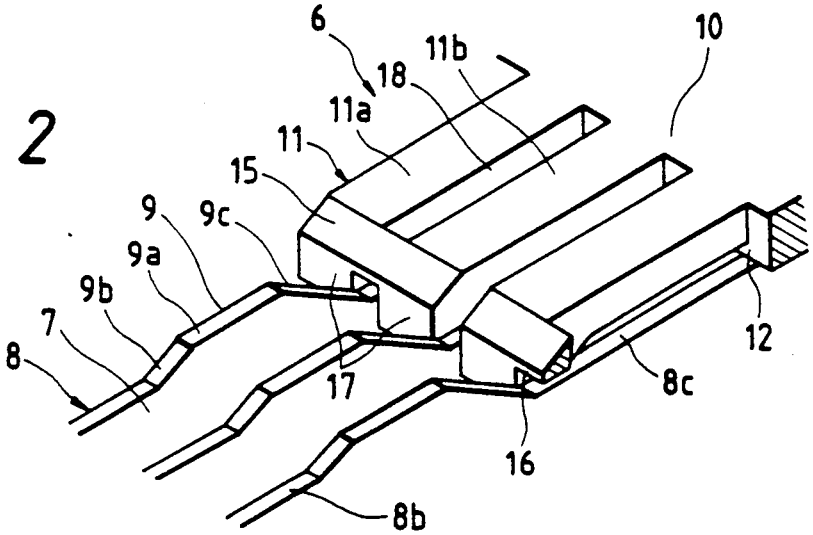
FIG. 2 is an enlarged fragmentary perspective view of the connector terminal holding mechanism, particularly showing a section A in FIG. 1.

FIG. 1 is a vertical sectional view of a connector terminal holding mechanism in accordance with the embodiment of the present invention, and FIG. 2 is an enlarged fragmentary perspective view of the connector terminal holding mechanism, particularly showing the structure of a section A in FIG. 1.

The connector terminal holding mechanism constructed in the above-described manner makes it possible to simultaneously hold a rear upright standing engagement portion 4 (i.e., part of a cable crimping portion 3 of a terminal 2 for a base board received in a connector housing 1) and an engagement shoulder 5*a* located at the rear end of a box-shaped portion 5 and having a height which is greater than the height of the upright standing engagement portion 4, wherein the box-shaped portion 5 has a resilient contact piece 23 integrated therewith at the foremost end thereof. With this construction, the foremost end of the rear holder 6 can reach the engagement shoulder 5*a* of the box-shaped portion 5 beyond the upright standing engagement portion 4 of the terminal 2 to come in close contact with the engagement shoulder 5*a*.

Specifically, a plurality of guide rail walls 8, each serving as a partition wall for a terminal receiving chamber 7, stand upright in parallel with each other in the connector housing 1 molded of a synthetic resin. Raised portions 9, each having a height greater than the height of the upright standing engagement portion 4 of the terminal 2, are formed at the intermediate positions of the guide rail walls 8 so that the rear holder 6 can move along the guide rail walls 8. Each raised portion 9 has a horizontal surface 9*a*, an inclined surface 9*b* extending forwardly of the horizontal surface 9*a* in a sloped manner, and an inclined surface 9*c* extending rearwardly of the horizontal surface 9*a* in a sloped manner. In this embodiment, a forward rail portion 8*b* extending forwardly of the inclined surface 9*b* is dimensioned to have a height slightly larger than the height of a rear rail portion 8*a* extending rearwardly to the rear inclined surface 9*c*.

Figure 3:
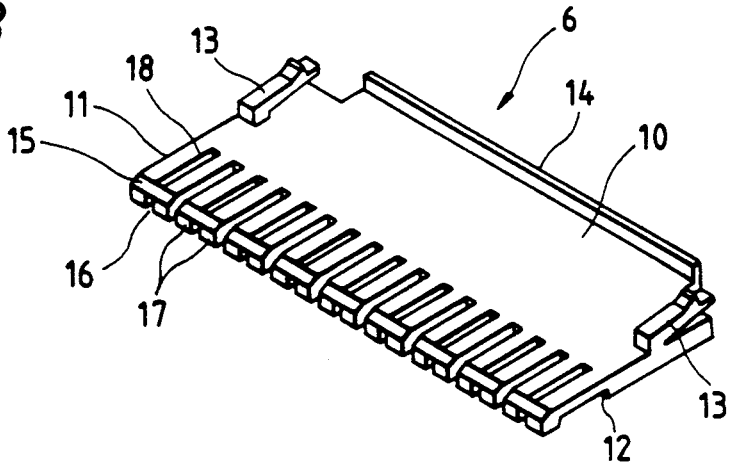
FIG. 3 is a perspective view of a rear holder for the connector terminal holding mechanism.

As shown in FIG. 3, the rear holder 6 is molded of a synthetic resin and constructed such that a flat plate portion 10 merges into an engagement projection 11 adapted to be engaged with the engagement shoulder 5*a* of the box-shaped portion 5 additionally a stepped engagement portion 12 adapted to be engaged with the upright standing engagement portion 4 of the terminal 2 is formed across the lower surface of the engagement projection 11, an opposing pair of flexible engagement arms 13 adapted to be engaged with the connector housing 1 are projected from the flat plate portion 10, and an actuation edge portion 14 is projected from the rear end of the flat plate portion 10.

The engagement projection 11 is constructed such that a pair of projection pieces 11*a* and 11*b* extending in parallel with each other are connected to each other via a transversely extending rod 15, a substantially inverted U-shaped slidable portion 16 adapted to be slidably engaged with the adjacent guide rail walls 8 is formed on the lower side of the transversely extending rod 15, the fore ends of the projection pieces 11*a* and 11*b* serve as engagement surfaces 17 adapted to be engaged with the engagement shoulder 5*a* of the box-shaped portion 5, and a slit between both the projection pieces 11*a* and 11*b* serves as a relief groove 18 for receiving the raised portion 9.

Figure 4:
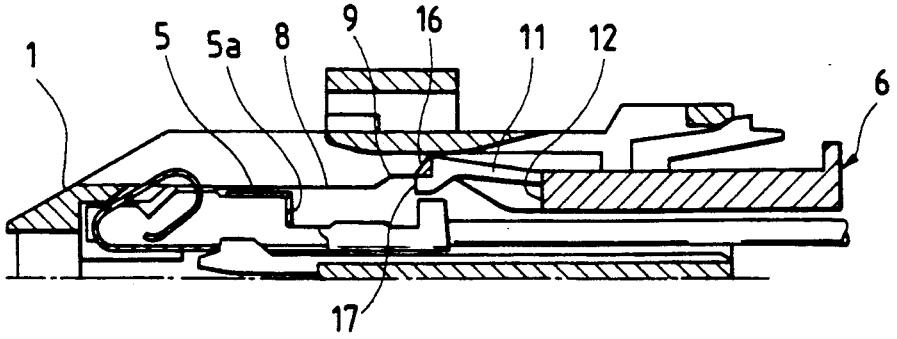
FIG. 4 is a vertical sectional view of the connector terminal holding mechanism, particularly showing the intermediate state that the rear holder is inserted into a connector housing.
Figure 5:
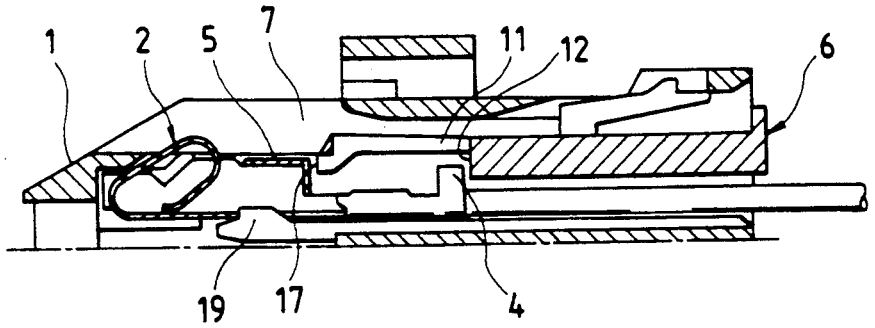
FIG. 5 is a vertical sectional view of the connector terminal holding mechanism, particularly showing the final state that the rear holder is fully inserted into the connector housing.

As shown in FIG. 4 and FIG. 5, as the rear holder 6 is moved into the interior of the housing 1, the slidable portions 16 slidably move along the upper surfaces of the guide rail walls 8, and across the raised portions 9 so as to pass over the upright standing position of the terminal. Therefore, the engagement surface 17 at the fore ends of each pair of projection pieces 11*a* and 11*b* is engaged with the engagement shoulder 5*a* of the box-shaped portion 5 at the rear end of the latter. At the same time, the stepped engagement portion 12 of the rear holder 6 is engaged with the upright standing portion 4 of the terminal 2, resulting in the terminal 2 being twice locked by the rear holder 6. Since the terminal 2 is previously kept locked by a flexible engagement piece 19 in the terminal receiving chamber 7, the result is that the rear holder 6 is thrice locked.

Figure 6:
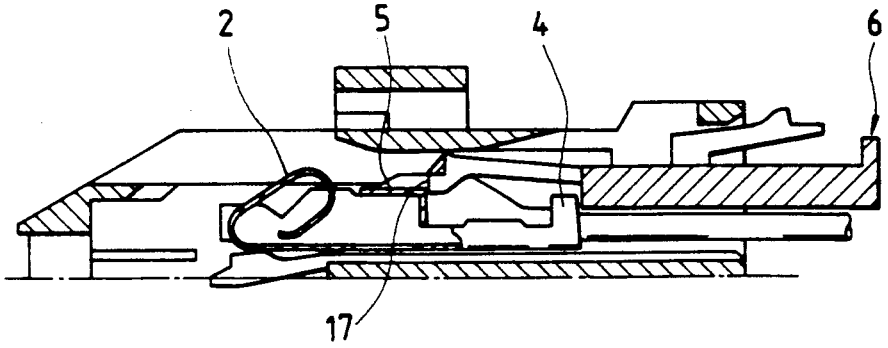
FIG. 6 is a vertical sectional view of the connector terminal holding mechanism, particularly showing the operative state that incomplete insertion of a terminal into the connector housing is detected and corrected.

As shown in FIG. 6, in addition to the engagement with the terminal 2, the rear holder 6 serves to detect that the terminal 2 is incompletely inserted into the connector housing 1, and subsequently, squeeze the terminal 2 toward a predetermined correct position. Since the engagement shoulder 5*a* of the box-shaped portion 5 is thrusted by the engagement surface 17 at the fore end of the rear holder 6 regardless of fluctuation of the height dimension, incomplete insertion of the terminal 2 can reliably detected, and moreover, the terminal 2 can reliably be squeezed in the connector housing 1 compared with the case that the upright standing engagement portion 4 of the terminal 4 is thrusted by the rear holder 6 with large fluctuation of the height dimension.

Figure 7A:
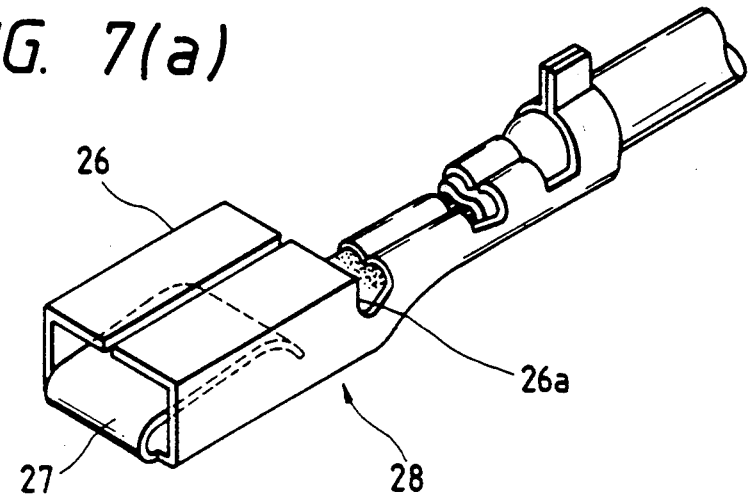
FIG. 7(*a*) is a perspective view of a female type terminal of the present invention.
Figure 7B:
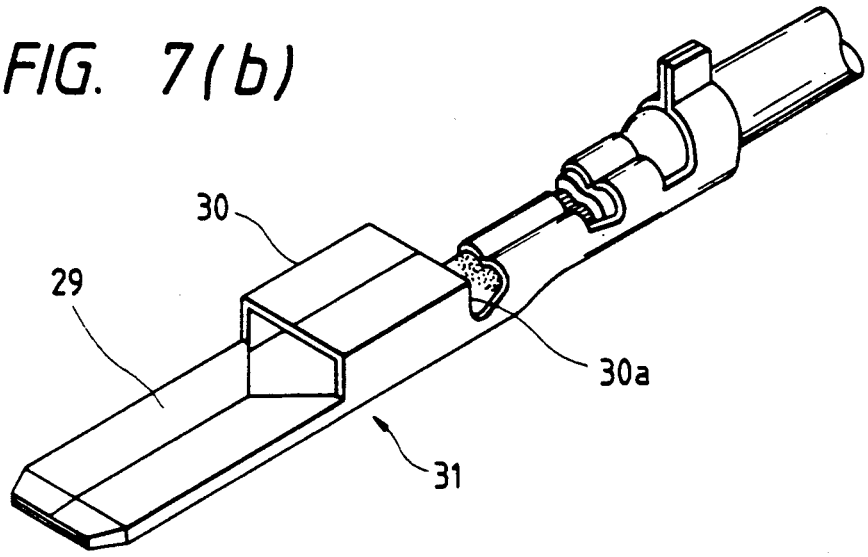
Figure 8:
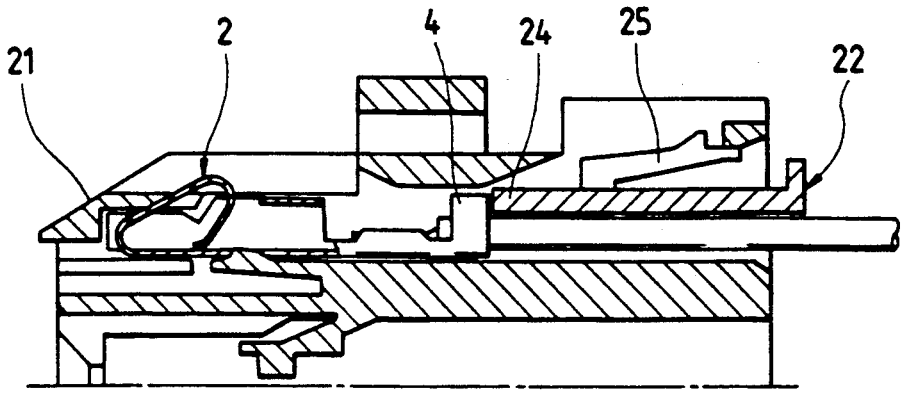
FIG. 8 PRIOR ART
FIG. 8 is a vertical sectional view of a conventional connector terminal holding mechanism.
Figure 9:
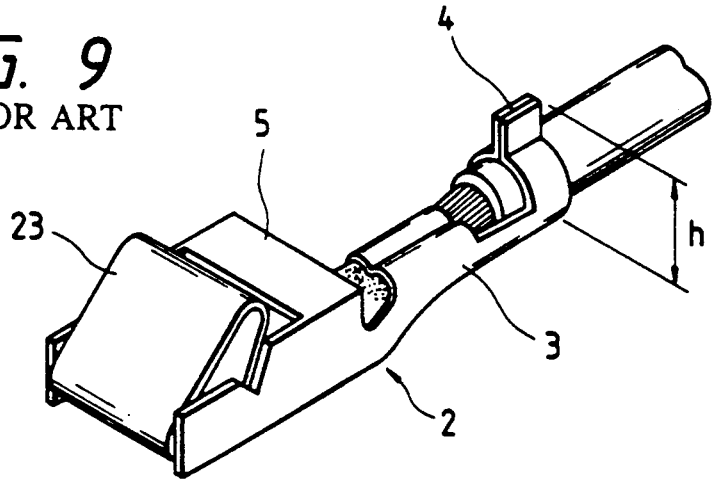
FIG. 9 PRIOR ART
FIG. 9 is a perspective view of a terminal to be inserted into a connector housing with the conventional connector terminal holding mechanism.

Incidentally, it is possible to use a female type terminal 28 having a resilient contact piece 27 formed in a box-shaped portion 16 including an engagement shoulder 26*a* as shown in FIG. 7(*a*) or a male type terminal 31 including a male tab-shaped contact portion 29 and a box-shaped portion 30 having an engagement shoulder 30*a* formed at the rear end thereof as shown in FIG. (*b*) for the connector terminal holding mechanism, in place of the terminal 2 constructed in the above-described manner. In the aforementioned embodiment, the upright standing engagement portion 4 is formed by a part of the crimping portion 3. Alternatively, the upright standing engagement portion 4 may separately be formed independently of the crimping portion 3.

As is apparent from the above description, according to the present invention, since the foremost end of the rear holder climbs the upright standing engagement portion of the terminal and then comes in contact with the engagement shoulder of the terminal, the terminal is twice locked by the rear holder in cooperation with the upright standing engagement portion and the engagement shoulder of the boxed-shaped portion, disconnection of the terminal from the connector housing in the rearward direction can reliably be prevented. In addition, with the connector terminal holding mechanism of the present invention, a reliable locking force can always be generated so as to allow the terminal to be locked in the connector housing without fail. Further, the rear holder makes it possible to detect incomplete insertion of the terminal, and moreover, correctly squeeze the terminal toward a predetermined correct position. Consequently, unexpected disconnection of the terminal from the connector housing can reliably be prevented.

What is claimed is:

1. A connector comprising:

a terminal including an upright standing engagement portion and an engagement shoulder located forwardly of said upright standing engagement portion;

a rear holder including an engagement projecting portion and a stepped engagement portion, said stepped engagement portion being engageable with said upright standing portion; and a connector housing including at least one guide rail which partially defines a terminal accommodating chamber in which said terminal is received, said at least one guide rail including a raised portion having a height which is greater than the height of said upright standing engaging portion, wherein said engagement projecting portion includes a slidable portion and a contact portion, said slidable portion being slidably engaged with said at least one guide rail, and said contact portion being brought into contact with said engagement shoulder of said terminal.

2. A connector as claimed in claim 1, wherein said raised portion has a horizontal wall, a first inclined wall extending forwardly toward said horizontal wall in a terminal inserting direction and a second inclined wall extending rearwardly of said horizontal wall.

3. The connector as claimed in claim 1, wherein said connector includes a plurality of said terminals, said connector housing includes a plurality of said guide rails which respectively define a plurality of said terminal accommodating chambers and said engagement projecting portion of said rear holder includes a plurality of slidable portions and contact portions.

* * * * *